US007311640B2

(12) United States Patent
Baatz

(10) Patent No.: US 7,311,640 B2
(45) Date of Patent: Dec. 25, 2007

(54) SYSTEM AND METHOD FOR VERIFYING THE CALIBRATION OF AN EXERCISE APPARATUS

(75) Inventor: Wilfried Baatz, Seattle, WA (US)

(73) Assignee: Racer-Mate, Inc., Seattle, WA (US)

( * ) Notice: Subject to any disclaimer, the term of this patent is extended or adjusted under 35 U.S.C. 154(b) by 681 days.

(21) Appl. No.: 10/366,633

(22) Filed: Feb. 12, 2003

(65) Prior Publication Data

US 2003/0181293 A1 Sep. 25, 2003

Related U.S. Application Data

(60) Provisional application No. 60/357,200, filed on Feb. 13, 2002.

(51) Int. Cl.
*A63B 21/00* (2006.01)
*A63B 22/00* (2006.01)

(52) U.S. Cl. ..... 482/4; 482/2; 482/8

(58) Field of Classification Search ..... 482/1–9, 482/900–902

See application file for complete search history.

(56) References Cited

U.S. PATENT DOCUMENTS 4,976,424 A * 12/1990 Sargeant et al. ..... 482/6
5,318,487 A * 6/1994 Golen et al. ..... 482/5
6,106,436 A 8/2000 Lundahl
6,302,829 B1 10/2001 Schmidt
6,450,922 B1 9/2002 Henderson et al.

* cited by examiner

*Primary Examiner*—Glenn Richman
(74) *Attorney, Agent, or Firm*—Christensen O'Connor Johnson Kindness PLLC

(57) ABSTRACT

A calibration verification system 20 comprises a trainer 40 having a load generator, a variable load control system (hidden by the cover of the load generator) connected in electrical communication with the load generator, and an exercise trainer computer system 140 connected in communication with the variable load control system. In operation, the exercise trainer computer system 140 outputs commands to the variable load control system. These commands can, for example, instruct the variable load control system to energize the load generator at predetermined times and power levels in order to simulate changes in terrain. The calibration verification system 20 also allows the user to verify the calibration of the trainer 40 by implementing a user initiated process, which conducts a calibration verification test of the trainer and outputs the test data at the exercise trainer computer system 140.

16 Claims, 7 Drawing Sheets

SYSTEM AND METHOD FOR VERIFYING THE CALIBRATION OF AN EXERCISE APPARATUS

CROSS-REFERENCE TO RELATED APPLICATION

The present application claims the benefit of U.S. Provisional Application No. 60/357,200, filed Feb. 13, 2002, the disclosure of which is hereby incorporated by reference.

FIELD OF THE INVENTION

The present invention relates generally to exercise apparatuses, and more particularly, to systems and computer software operable to verify the calibration of such apparatuses.

BACKGROUND OF THE INVENTION

Cycling is a very popular activity for both recreational riders and racing enthusiasts alike. Professional cyclists and triathletes are earning large sums of money through races, sponsorships, and advertisements. Moreover, cycling provides many health benefits for average riders in that it strengthens various muscle groups along with providing aerobic and anaerobic exercise to the user. Furthermore, physicians and physical therapists are turning to stationary cycle devices to rehabilitate patients from automobile, athletic, or work-related injuries. Because of this, there is a demand for indoor, stationary exercise trainers that simulate actual outdoor riding so that professional and recreational cyclists may train or exercise regardless of the weather, and that patients can rehabilitate injuries in the presence of their physicians and physical therapists.

Various stationary cycle trainers have been presented to address this need. Conventional stationary cycle trainers simulate the characteristics of outdoor training by applying a variable resistance device to provide resistance against the pedaling of the rider. The variable resistance device mimics the resistances a rider would face during actual outdoor training such as wind resistance, rolling resistance, and resistances due to riding over varying terrain. Recently, the use of "eddy current" trainers have achieved widespread use due to their ability to simulate the resistance (loads) felt by riders during actual riding.

Further advancements in "eddy current" trainers allow for the monitoring and evaluation of the rider's or patient's performance during the exercise session. These trainers generally use a microprocessor/sensor arrangement to calculate several session parameters, such as heart rate, energy exertion, time elapsed, and distance. The microprocessor is also connected to an electric drive circuit that energizes the electromagnets at predetermined times and power levels in order to simulate changes in terrain. An eddy current trainer that uses electromagnets to simulate real life bicycling road conditions, and that uses a microprocessor to evaluate the user's performance, is sold under the trademark COMPU-TRAINER by Racermate, Inc., Seattle, Wash.

Although the use of electromagnets and microprocessor has dramatically improved such "eddy current" trainers, there are still limitations that exist. For example, it is well known that mechanical and electrical systems can drift out of initial calibration, thus generating erroneous data. This is important to a majority of the riders that use these trainers, especially professional athletes, since they need to know if the session parameter data received during the exercise session is still accurate. At the present time, the only method to determine if the trainer is still within a predetermined margin of error of its initial factory calibration is to return the trainer to the factory for testing, which can be prohibitively expensive.

SUMMARY OF THE INVENTION

In accordance with aspects of the present invention, a system for verifying the calibration of an exercise apparatus is provided. The system includes an exercise apparatus having an operational characteristic for calibration. The exercise apparatus includes a load generator, a flywheel assembly associated with the load generator, and a variable load control system including a controller. The controller of the variable load control system being operable for initiating the load generator, obtaining signals indicative of the operation of the trainer, obtaining a current operational characteristic for calibration, and determining whether the current operation characteristic substantially matches the operational characteristic for calibration of the apparatus.

In accordance with another aspect of the present invention, a method for verifying the calibration of an exercise trainer is provided. The trainer includes a flywheel assembly rotated through user input, and a load generator through which a portion of the flywheel assembly rotates. The method comprises obtaining a user start command; obtaining an operational characteristic of the trainer; testing the calibration of the trainer when the operational characteristic of the trainer equals a pre-selected threshold value; and displaying results of the calibration test.

In accordance with yet another aspect of the present invention, a method for verifying the calibration of the exercise trainer is provided in a system having an exercise trainer with a load generator and a flywheel assembly. The system has an operational characteristic for calibration. The method includes initiating the load generator; obtaining signals indicative of the operation of the trainer; obtaining a current operational characteristic for calibration; and determining whether the current operation characteristic substantially matches the operational characteristic for calibration.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
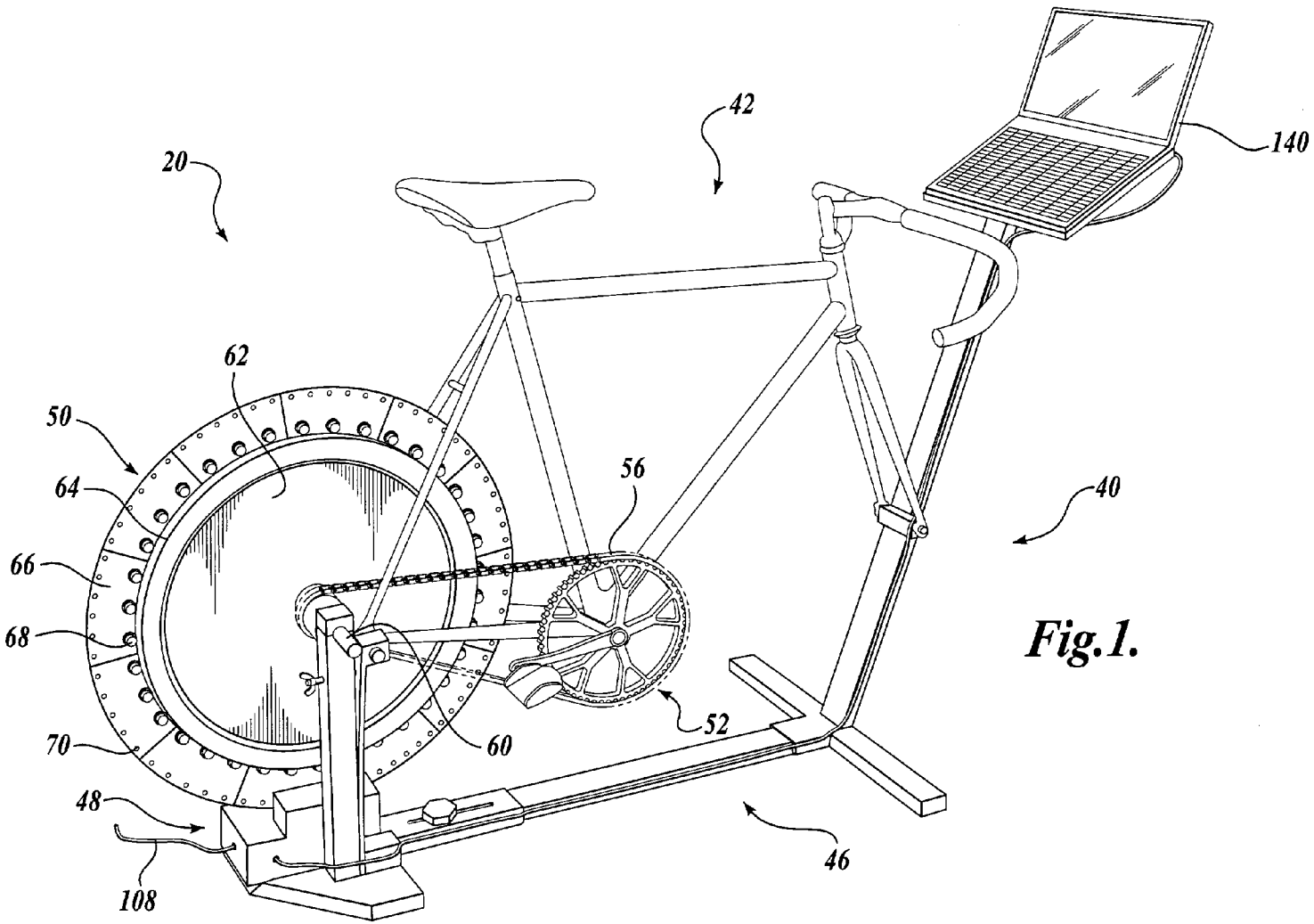
FIG. 1 is a perspective view of a calibration verification system formed in accordance with the present invention.

The present invention will now be described with reference to the accompanying drawings where like numerals correspond to like elements. One suitable embodiment of a system for verifying the calibration of an exercise apparatus formed in accordance with the present invention is illustrated in FIGS. 1-6. Referring to FIG. 1, the calibration verification system 20 comprises an exercise apparatus or trainer 40 having a load generator, a variable load control system (hidden by the cover of the load generator) connected in electrical communication with the load generator, and an exercise trainer computer system 140 connected in communication with the variable load control system. In operation, the exercise trainer computer system 140 outputs commands to the variable load control system. These commands can, for example, instruct the variable load control system to energize the load generator at predetermined times and power levels in order to simulate changes in terrain. The calibration verification system 20 also allows the user to verify the calibration of the trainer 40 by implementing a user initiated process, which conducts a calibration verification test of the trainer and outputs the test data at the exercise trainer computer system 140.

FIG. 1 illustrates a bicycle 42 removably mounted to the trainer 40. The trainer 40 includes a support frame 46 for supporting the bicycle 42 in an upright position and a resistance generation unit 48 for providing a load to the user that simulates actual cycling resistance. The resistance generation unit 48 includes a flywheel assembly 50 mounted on an axle journaled across the lower ends of the rear forks of the bicycle 42. The flywheel assembly 50 is rotatably coupled to a chain drive mechanism or transmission 52 of the bicycle 42 by a continuous chain 56 in a manner well known in the art. As the user pedals the bicycle 42, a portion of the flywheel assembly 50 begins to rotate within the load generator of the resistance generation unit 48, which will be described in more detail below. The portion of the flywheel assembly 50 induces eddy-currents therein due to the magnetic field generated by the load generator. The eddy-currents place a load or resistance against the rotation of the flywheel assembly 50. This resistance is transmitted from the flywheel assembly 50 to the user through the chain 56 so that the user is required to exert power to sustain the pedaling of the bicycle 42. For a more detailed description of the trainer 40, please see co-pending application Ser. No. 09/718,885, which is hereby incorporated by reference.

Figure 2:
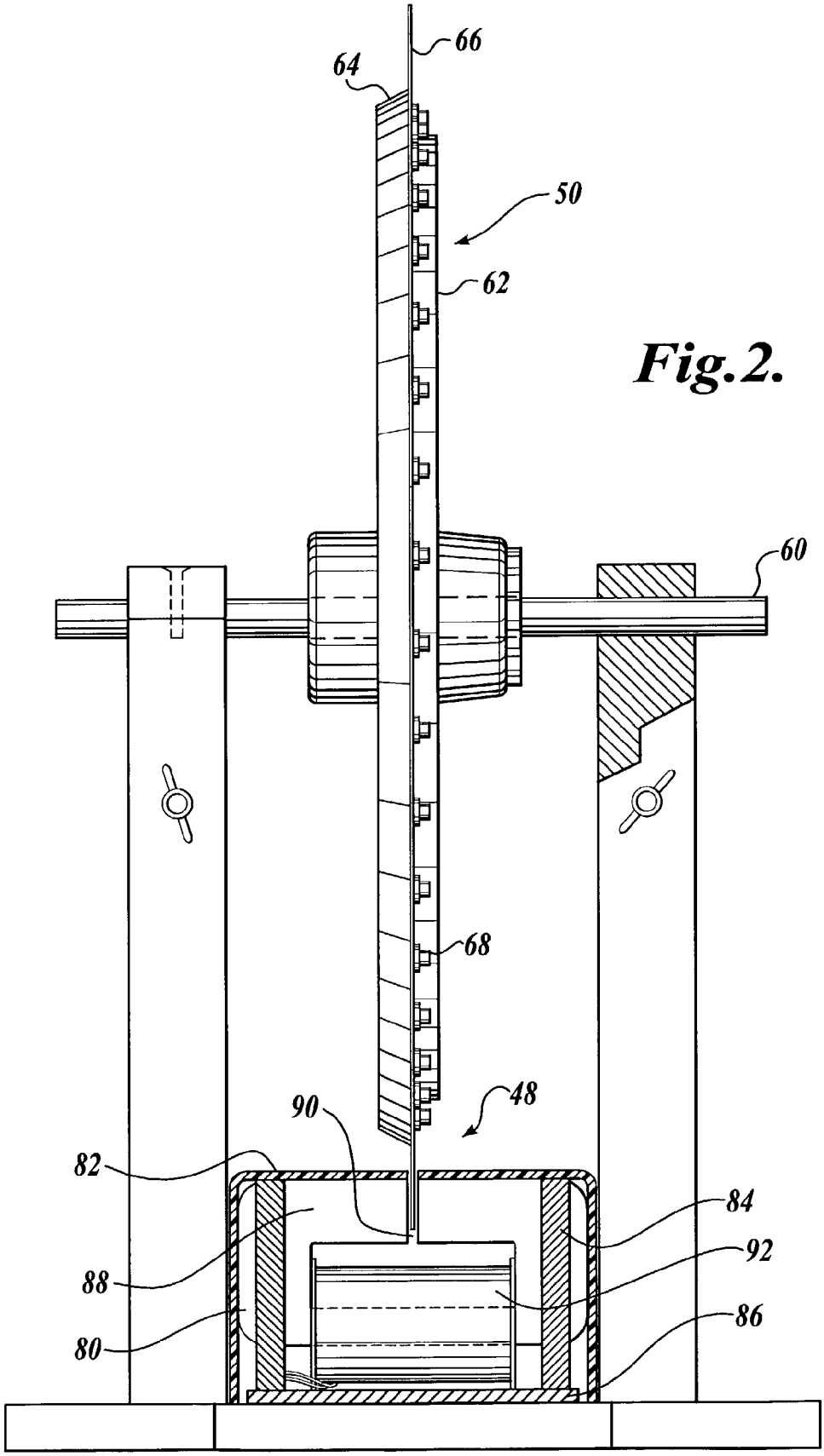
FIG. 2 is a rear view of a calibration verification system of FIG. 1.

As best shown in FIGS. 1 and 2, the flywheel assembly 50 is rotatably coupled to the rear mounting assembly by a cylindrical shaft 60. The flywheel assembly 50 includes a flywheel 62 in the shape of a disk, preferably having a solid mass and constructed of metal, such as iron, although other materials may be used. The flywheel 62 provides substantial rotational inertia to the flywheel assembly 50. The flywheel 62 includes an outer peripheral flange 64 to which a plurality of segments or sections 66 are coupled thereto to form a segmented ring. The sections 66 extend radially outward past the flange 64 and are removably coupled at the base of the flange 64 by fasteners 68 well known in the art. Slots 70 (FIG. 1) are disposed at the outer peripheral end of each section 66, and are utilized by a photo-sensor and light source combination, not shown but well known in the art, to create an output in the form of a pulsed signal or count that can be read by a controller and stored in memory. The sections 66 are made of a nonmagnetic, electrically conductive metal, such as copper. The sections 66 rotate through the magnetic fields generated by the load generator of the resistance generation unit 48, thereby inducing eddy-currents therein.

The resistance generation unit 48 further includes a load generator 80. A cover 82 is mounted over the load generator 80 to protect it from dust, dirt, and debris. Inside the cover, the load generator 80 includes two vertical support members 84 coupled to a base plate 86. A C-shaped member 88 having a gap 90 is coupled to each side of the vertical support members 84. A coil 92 is wrapped around each C-shaped member 88 and is connected to a source of variable current through an electric drive circuit, as will be described in more detail below. The variable current source delivers current through the coils 92 at predetermined times and at various selected levels to produce magnetic fields between the gaps 90. The structure and operation of the electromagnet and variable current source are well known to those of ordinary skill in the art; therefore, it is readily understood how to construct the load generator and variable current source.

Figure 3:
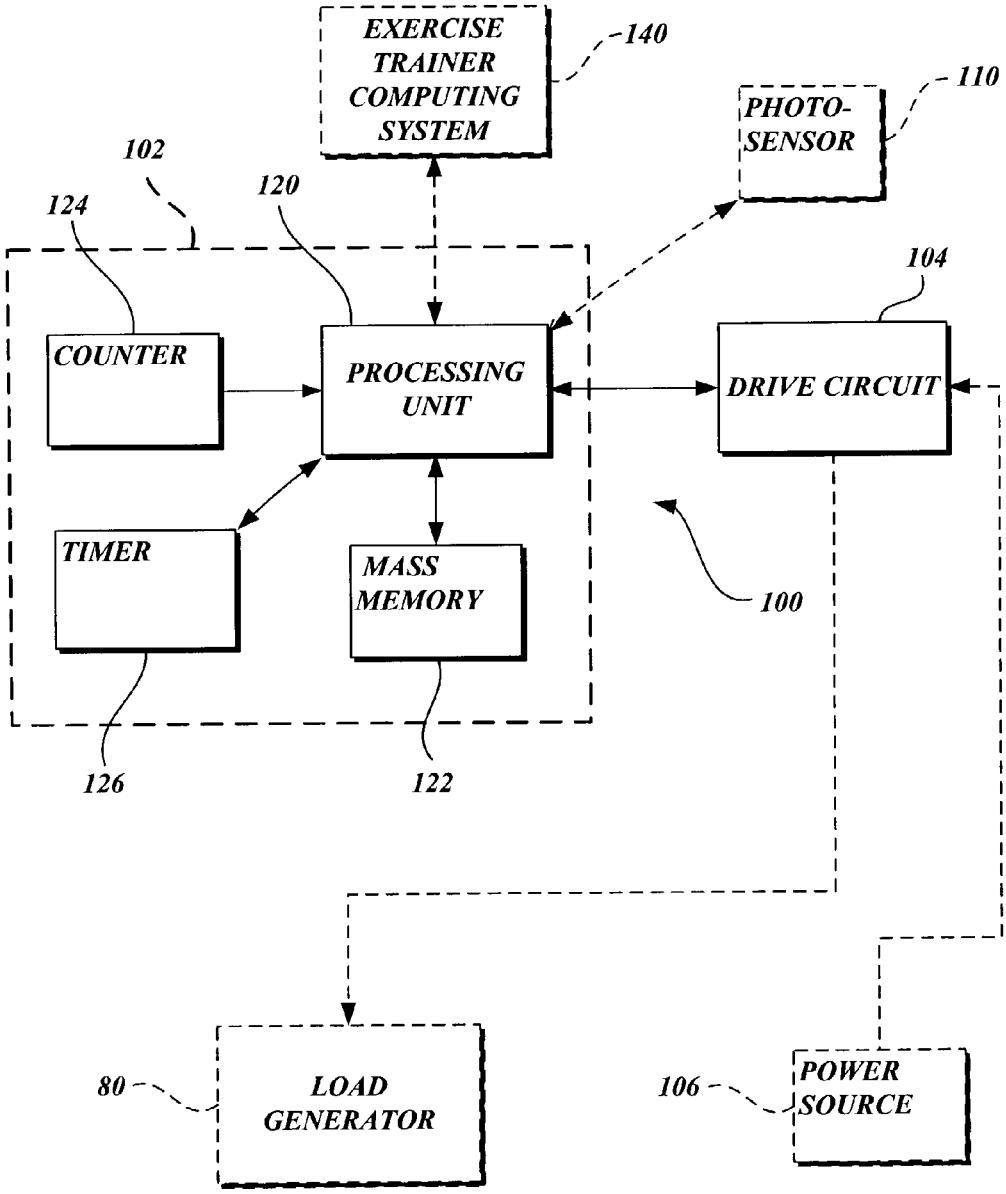
FIG. 3 is a block diagram depicting an illustrative architecture for a variable load control system formed in accordance with the present invention.

Referring now to FIG. 3, the calibration verification system 20 also includes the variable load control system 100 connected in electrical communication with the trainer 40. The variable load control system 100 includes a controller 102 and an electrical drive circuit 104. The drive circuit 104 includes conventional components, such as operational amplifiers, resistors, and capacitors, and shares the circuit board of the load generator. The electrical drive circuit 104 is connected to a power source 106 by an electrical cable 108 (FIG. 1). The electrical drive circuit 104 energizes the coils at predetermined times and power levels to produce magnetic fields between the gaps in the C-shaped members of the load generator. The structure and operation of the electrical drive circuit are well known to those of ordinary skill in the art. Therefore, it would be readily understood by one of ordinary skill in the art how to construct an appropriate electrical drive circuit, and thus, will not be described in detail.

The variable load control system 100 also contains a controller 102 that is in electrical communication with the drive circuit 104. The controller 102 includes a logic system for receiving data from the photo-sensor 110, determining session parameters, such as the speed of the flywheel assembly and its corresponding simulated travel speed in miles per hour for the stationary trainer, and transmitting data to the exercise trainer computer system 140. The controller 102 also includes a logic system for initiating the electrical drive circuit 104 to energize the coils of the load generator at predetermined times and power levels. It will be appreciated by one skilled in the art that the logic may be implemented in a variety of configurations, including but not limited to, analog circuitry, digital circuitry, processing units, and the like. In the embodiment illustrated in FIG. 3, the controller 102 is in the form of a processing unit 120, a memory 122, a counter 124, and a timer 126 connected in a conventional manner. The memory 122 may include random access memory (RAM), read only memory (ROM), or any other type of digital data storage means.

Figure 4:
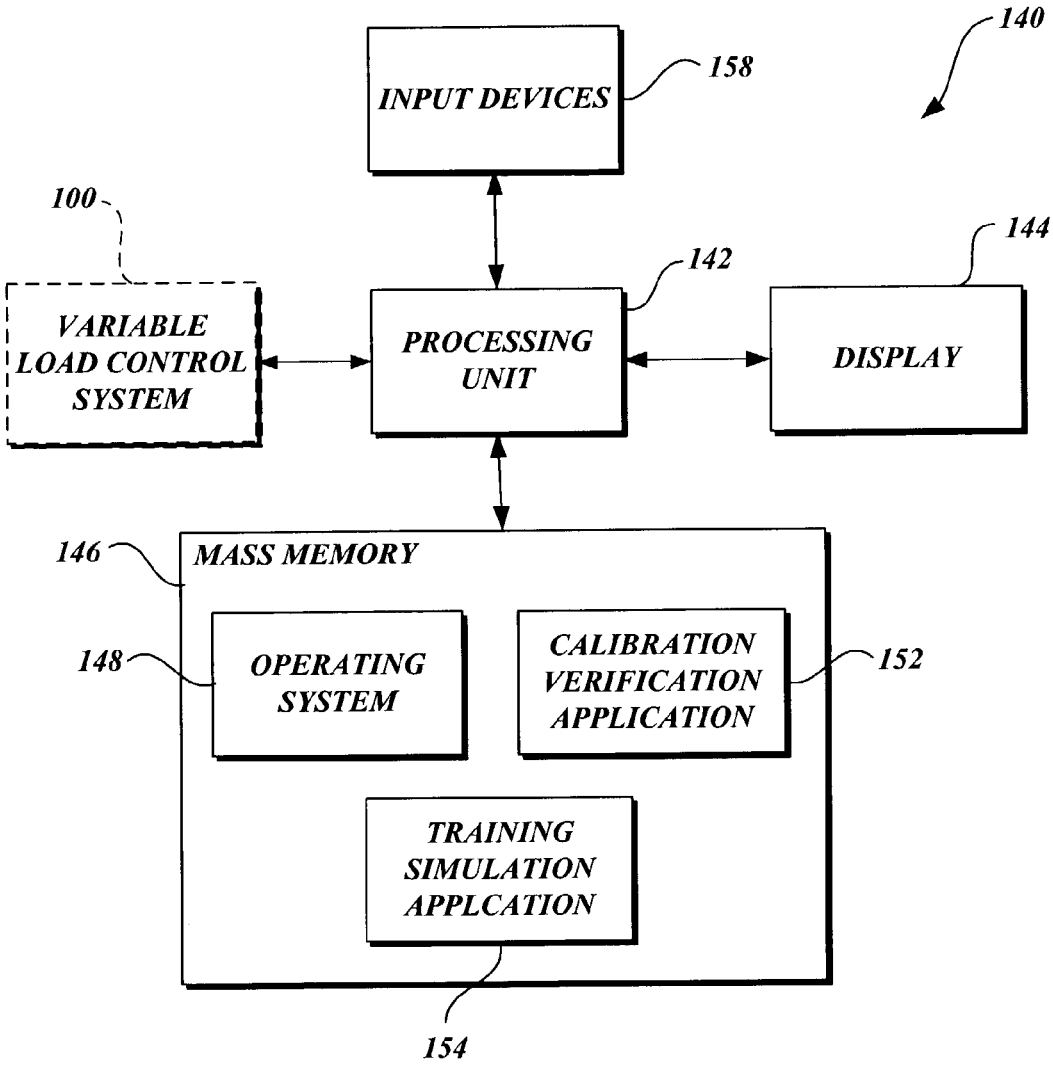
FIG. 4 is a block diagram depicting an illustrative architecture for an exercise trainer computer system formed in accordance with the present invention.

The system 20 further includes an exercise trainer computer system 140 connected in electrical communication with the variable load control system 100. Turning now to FIG. 4, an illustrative architecture for the exercise training computer system 140 will be described. Those of ordinary skill in the art will appreciate that the exercise training computer system 140 includes many more components then those shown in FIG. 4. However, it is not necessary that all of these generally conventional components be shown in order to disclose an illustrative embodiment for practicing the present invention.

As shown in FIG. 4, the computer system 140 includes a processing unit 142, a display 144, and a memory 146. The memory 146 generally comprises a random access memory ("RAM"), a read-only memory ("ROM") and a permanent mass storage device, such as a disk drive. The memory 146 stores an operating system 148 for controlling the operation of the computer system 140. In one actual embodiment of the invention, the operating system 148 provides a graphical operating environment, such as Microsoft Corporation's WINDOWS® graphical operating system in which activated application programs are represented as one or more graphical application windows with a display visible to the user.

The mass memory 146 also stores program codes and data for verifying the calibration of the trainer 40, and for generating and transmitting simulation training data to the variable load control system 100. More specifically, the mass memory 146 stores a calibration verification application 152 in accordance with the present invention. The calibration verification application 152 comprises computer-executable instructions that, when executed by the exercise trainer computing system 140, obtain and transmit calibration verification data, as will be explained in greater detail below. The memory 146 further includes a training simulation application 154. It will be appreciated that these components may be stored on a computer-readable medium and loaded into the memory 146 of the computer system 140 using a drive mechanism associated with the computer-readable medium, such as a floppy, CD-ROM or DVD-ROM drive. Suitable training simulation applications, which may be used by the present invention, are sold under the names Pro PC, Pro 3D, and Pro NES, by Racermate, Inc., Seattle, Wash.

The display 144 and memory 146 are connected to the processing unit 142 via one or more buses, not shown but well known in the art. Computer system 140 may also include several input devices 158, such as keyboards, touch pads, mice, to name a few, which are connected to the processing unit 142 via one or more buses. As would be generally understood, other peripherals may also be connected to the processing unit in a similar manner. In the embodiment shown, the computer system 140 is connected to the variable load control system 100 via a communication cable through a communication data port, such as a serial port. However, it will be appreciated that any wired or wireless connection known in the art may be practiced with the present invention.

Figure 5A:
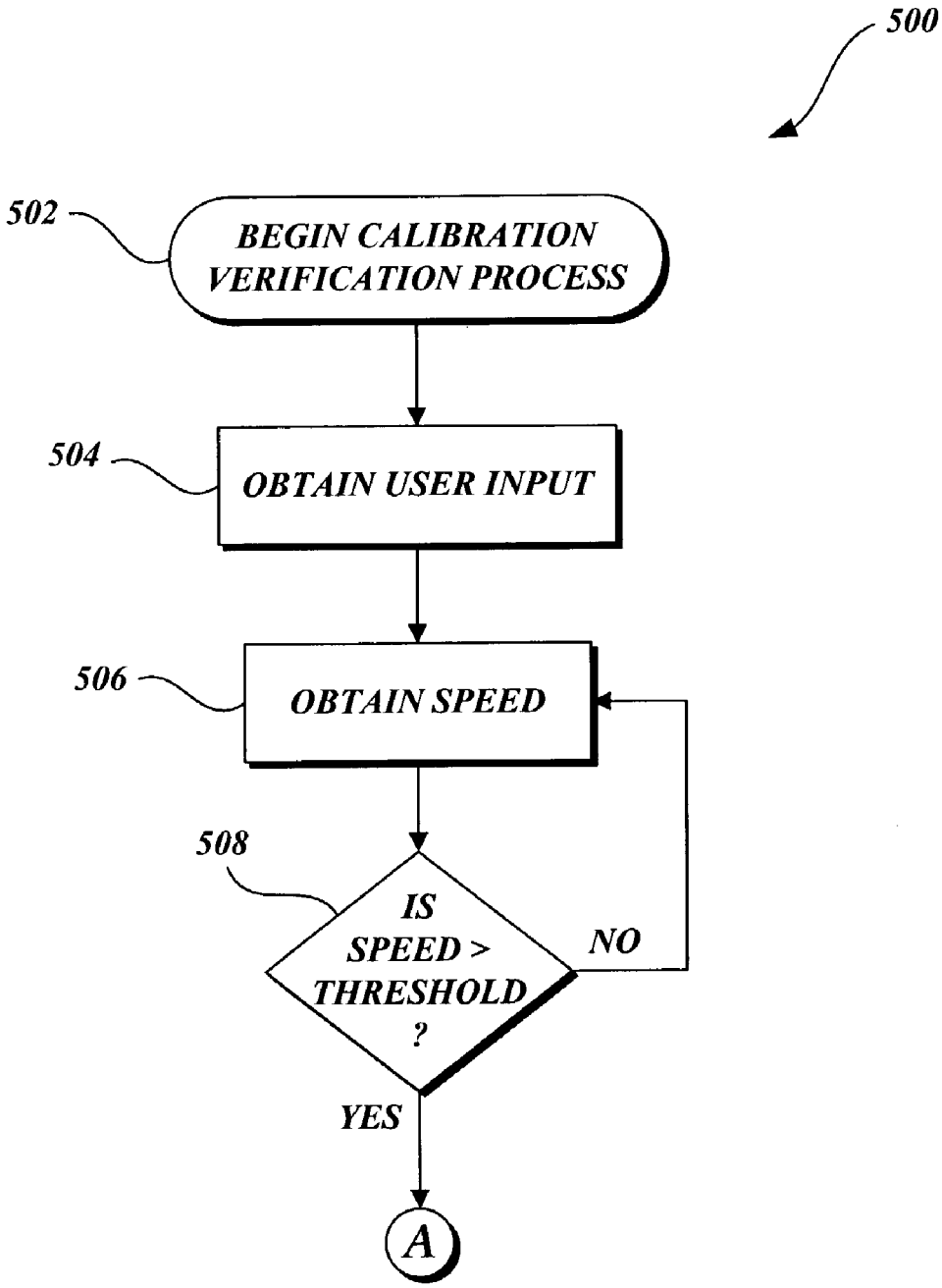
FIGS. 5A and 5B are a flow diagram of an exemplary embodiment of a process routine for verifying the calibration of the bicycle ergometer in accordance with the present invention.
Figure 5B:
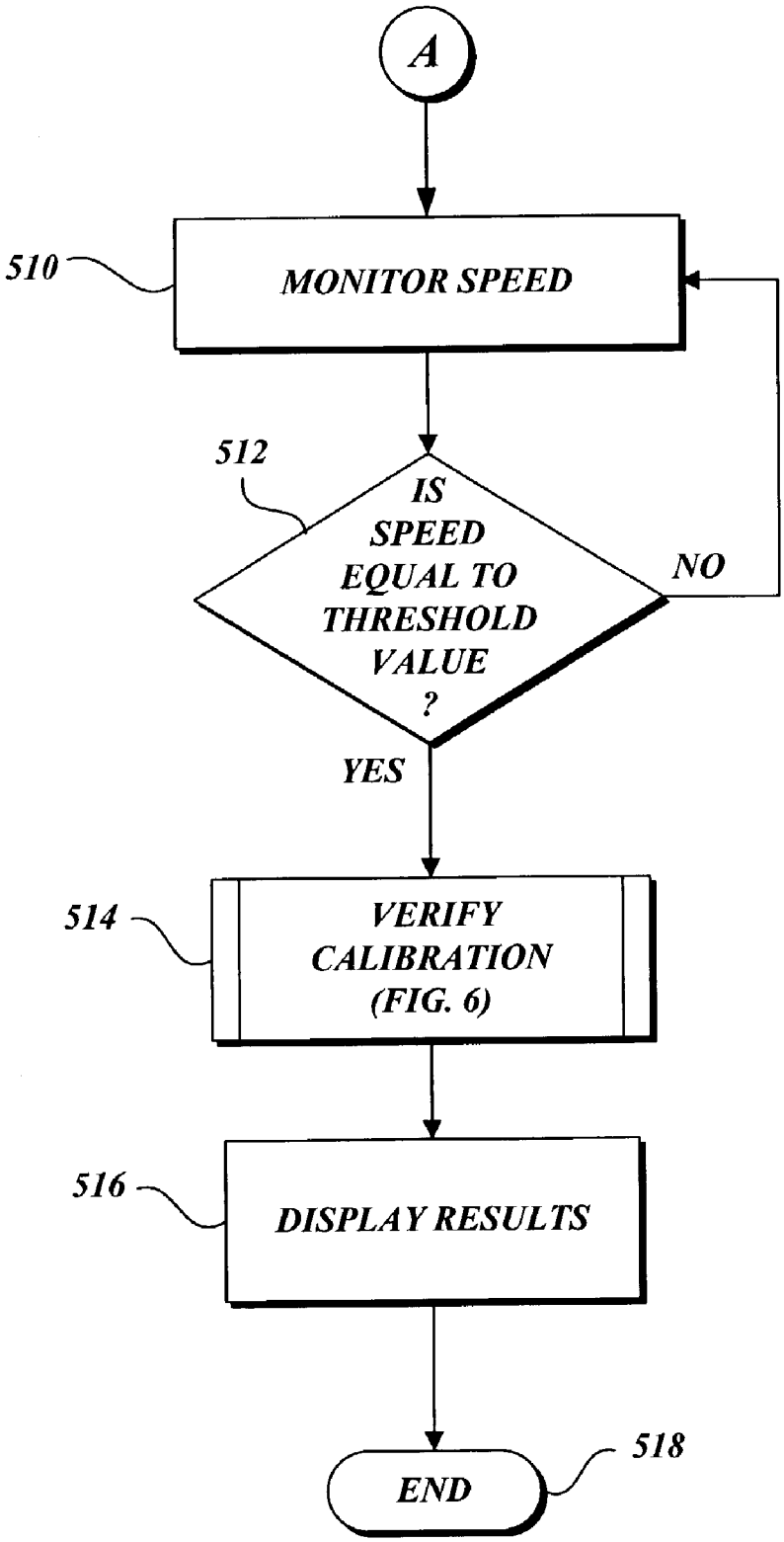

FIGS. 5A and 5B are a flow diagram depicting a calibration verification process routine 500 in accordance with aspects of the present invention. The routine 500 verifies to the user whether or not the trainer 40 is out of the initial factory calibration due to such problems as electrical component failure or mechanical misalignment. Before the calibration verification process 500 can be initiated, the user is preferably mounted on the trainer 40 in the normal training position. Once the user has attained the training position, the process routine 500 begins at block 502 and proceeds to block 504, where the user's calibration verification initiation command is obtained. For example, the user may press any key or combination of keys on the keyboard of the exercise training computer system 140 to enter into a calibration verification mode. Next, at block 506, an operational characteristic of the trainer, namely, the speed of the flywheel assembly 50 is obtained. In the illustrative embodiment, the user rotates the flywheel assembly 50 by pedaling the bicycle 42 or other means up to a speed greater than a predetermined threshold speed, e.g., 10 miles per hour, prior to or after initiating the verification process, and then discontinues pedaling. The speed of the flywheel assembly 50 is calculated by the processing unit 120 from data obtained from the photo-sensor 110 and may be displayed to the user on the display 144 of the exercise training computer system 140 so that the user is aware of when to stop pedaling. It will be appreciated that the controller 102 may calculate the speed of the flywheel assembly 50 in revolutions per minute or may calculate the speed of the flywheel assembly in miles per hour.

Then, a determination is made whether the speed of the flywheel assembly 50 is greater than the predetermined threshold value. If, at block 508, it is determined that the current speed of the flywheel assembly 50 is greater than the predetermined threshold value, the process routine 500 proceeds to block 510 to continue to monitor the speed of the flywheel assembly. If the speed obtained is not greater than the threshold valve, the routine 500 returns to block 506.

From block 510, the routine proceeds to block 512, where a determination is made if the current speed of the flywheel assembly 50 is equal to the predetermined threshold valve. If it is determined at block 512 that the current speed of the flywheel assembly is equal to the threshold valve, the routine proceeds to block 514 to verify the calibration of the trainer 40, as will be described in more detail below. If not, the process routine 500 returns to block 510 to monitor the current speed of the flywheel assembly 50. After the calibration is verified at block 514, the process continues to block 516, where the results are displayed on the display 144. The process ends at block 518.

In an illustrative embodiment, the results may be displayed on the display 144 in total time. The routine may optionally include a comparator function that compares the results of the calibration test to the initial results determined at the factory, which can be stored in memory 122. In this embodiment, the results from the comparator function may be displayed on the display. For example, the results from the comparator function may be displayed as a "Yes", indicating that the trainer is still in calibration, or "No", indicating that the trainer is out of calibration. Alternatively, the results may be displayed by an indication light. For example, after the test is complete and the results are compared with the initial factory calibration value, a green light or green "OK" signal may illuminate to indicate that the trainer is still within a specified percentage of error of the original calibration test typically run at the factory. Similarly, a red light may be used to signal that the trainer is out of calibration and need of servicing.

Figure 6:
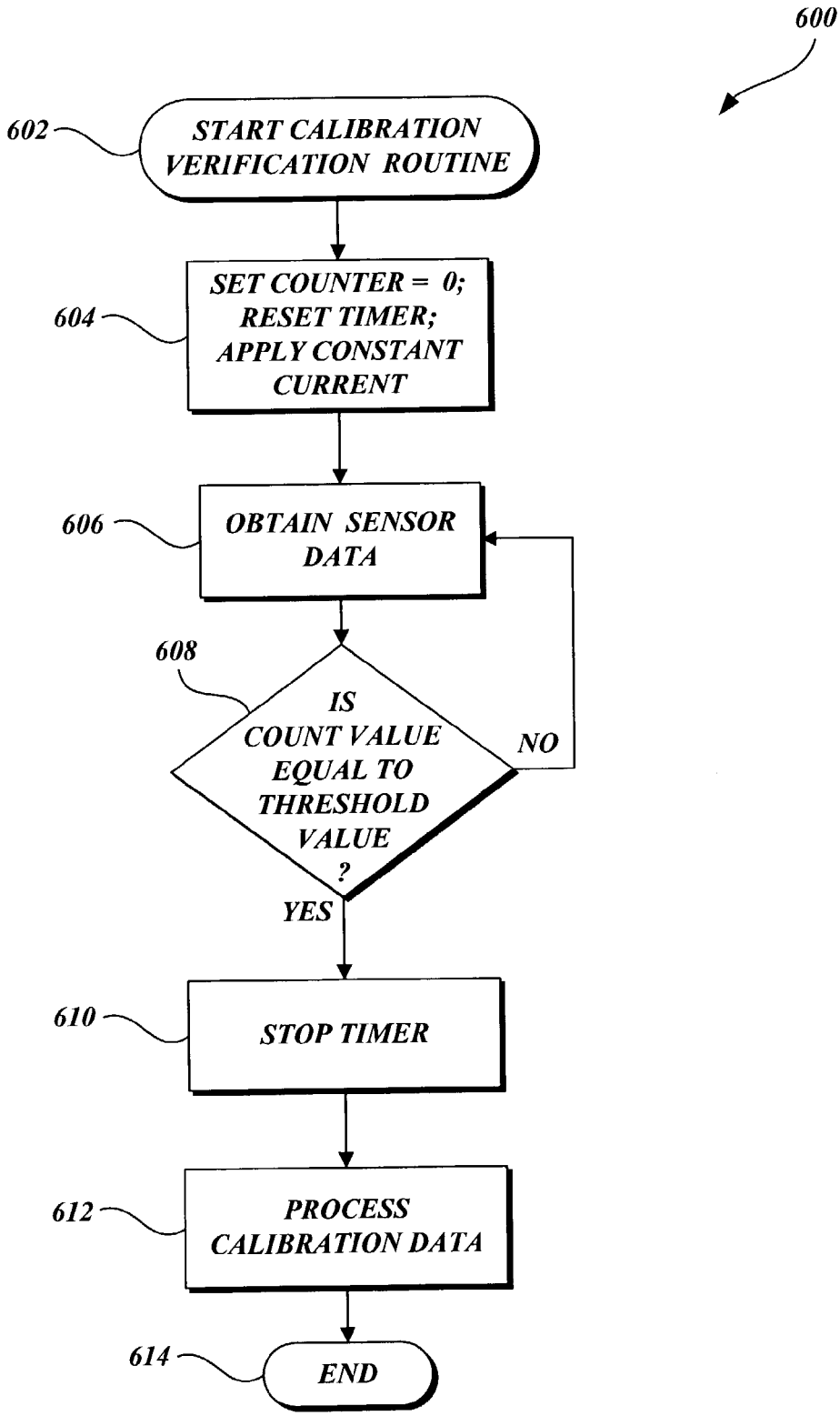
FIG. 6 is a flow diagram of an exemplary embodiment of a calibration verification subroutine in accordance with the present invention.

Referring now to FIG. 6, an illustrative calibration verification subroutine 600 will be described in detail. The routine 600 begins at block 602 where the processing unit 120 of the variable load control system 100 receives a command from the verification application 152 of the exercise trainer computer system 140, and proceeds to block 604, where the counter 124 is set to zero and the time 126 is reset. At the same time, the variable control system 100 sends a constant current, e.g., two amps, via the drive circuit 104 to the load generator 80. This creates magnetic fields through which the flywheel assembly 50 rotates, thereby applying a resistance against the rotation of the flywheel assembly 50. Next, at block 606, the processing unit 120 of the variable load control system 100 obtains sensor data from the photo-sensor 110 in the form of counts, the number of counts being stored by the counter 124.

While the illustrative embodiment sends a constant current, e.g., two amps, via the drive circuit 104 to the load generator 80, it will be appreciated by those skilled in the art that a constant voltage may alternatively be used. Additionally, it will be appreciated that a variable current or voltage may be used as long as the variable current or voltage is the same for each calibration test.

Then, a determination is made at block 608 by the processing unit 120 whether the count value of the counter 124 is equal to a predetermined stop number. For example, the flywheel assembly 50 of the illustrative embodiment of the trainer 40 has 72 slots around its peripheral to generate signals. Thus, the predetermined stop number can be selected, for example, by allowing the flywheel assembly 50 to rotate through, for example, two revolutions. Thus, the predetermined number is 144 (72 slots times 2 revolutions). If, at block 608, it is determined that the count value of the counter 124 is equal to the predetermined stop number of counts, i.e., 144 counts, the routine proceeds to block 610, where the timer 126 is stopped. If not, the routine loops back to block 608 and continues to obtain sensor data. After block 610, the routine proceeds to block 612, where the routine processes the calibration data, or the results of the calibration test. Processing the calibration data may include, but is not limited to, sending the time value of the timer 126 to the exercise trainer computer system 140 for display, or using an optional comparator function to compare the results of the calibration test to the initial results determined at the factory, which may then be sent to the system 140 for display. The subroutine 600 ends at block 614. It will be appreciated that the time value calculated by the calibration test represents the current calibration characteristic of the trainer, which can be compared by the optional comparator to the initial calibration characteristic determined at the factory.

Thus, in the illustrative subroutine, the number of counts determines when the timer is commanded to stop and the data obtained. It will be appreciated that any number of counts may be used, and that the flywheel assembly may contain any number of slots for cooperating with the photosensor to output the count signals. Alternatively, it will be appreciated that instead of using a predetermined number of counts to trigger the timer to stop, the timer may be commanded to stop when the flywheel assembly is slowed to a certain speed, for example, 5 miles per hour. Thus, in this embodiment, the duration of the test is measured by the time it takes for the flywheel assembly to slow from the start speed, (e.g., 10 mph) to the stop speed (e.g., 5 mph), while a pre-selected constant current is applied to the load generator instead of a pre-selected number of flywheel assembly revolutions. In both cases, the total elapsed time is representative of the current calibration value of the exercise trainer, which can then be compared to the initial time value, that is, the initial calibration value of the exercise trainer determined at the factory to determine whether the exercise trainer is calibrated.

The system 20 formed in accordance with the present invention provides the user the ability to verify the calibration of the trainer 40, namely, the electrical components of the drive circuit, the variable load generating system, and the alignment of the various mechanical components. Since the inertia of the flywheel assembly 50 remains constant throughout the life of the trainer 40, and the current or voltage supplied to the load generator is constant during the process routine, the results of the calibration verification process routine 500 should be within a predetermined margin of error of the initial results run at the factory if the trainer 40 is still properly calibrated. If the results of the calibration verification process are greater than a predetermined margin of error (e.g., 1%-1.5%) of the initial results run at the factory, the user will know that a problem exists in either the trainer software or hardware. Additionally, in embodiments without the comparator, the user may repeat the calibration verification process routine 500 to check the repeatability of the results, e.g., time to complete the test. In most cases, repeatability of the results is interpreted by users that the trainer is correctly calibrated, and thus, accurate.

It will be appreciated that the factory calibration value of the exercise trainer stored in memory 122 can be generic to all trainers produced at that factory. For example, the exercise trainers could be randomly tested to determine the average factory calibration value. Then, the calibration verification system of the present invention could compare the current calculated calibration value (in total elapsed time) to the average factory calibration value to determine if the trainer is still within a pre-selected margin of error.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A method for verifying the calibration of an exercise trainer, the trainer having a flywheel rotated through user input, and a load generator through which an outer portion of the flywheel rotates, the method comprising:

obtaining a user start command;

obtaining data indicative of flywheel rotational speed of the trainer;

applying a load generated by the load generator onto the outer portion of the flywheel as the outer portion of the flywheel rotates through the load generator;

obtaining signals indicative of flywheel rotation;

determining calibration test data for the current operation of the trainer from the obtained signals.

2. The method of claim 1, further comprising displaying the calibration test data for the current operation of the trainer.

3. The method of claim 1, wherein obtaining signals includes obtaining counts indicative of flywheel rotation.

4. The method of claim 3, wherein determining calibration test data for the current operation of the trainer includes measuring a period of time necessary to achieve a pre-selected count value.

5. The method of claim 1, wherein the signals are indicative of an estimated travel speed associated with flywheel assembly rotation.

6. The method of claim 5, wherein determining calibration test data for the current operation of the trainer includes calculating the total time elapsed from a first travel speed to a second travel speed.

7. In a system having an exercise trainer with a load generator and a flywheel, wherein the system has standard calibration data, a method for verifying the calibration of the exercise trainer, comprising:

applying a load generated by the load generator onto the outer portion of the flywheel as the outer portion of the flywheel rotates through the load generator;

obtaining signals indicative of flywheel rotational speed of the trainer;

obtaining a current calibration data for the trainer; and determining whether the current calibration data substantially matches the standard calibration data.

8. The method of claim 7, wherein obtaining signals includes obtaining counts indicative of flywheel rotation.

9. The method of claim 8, wherein obtaining a current calibration data for the trainer includes measuring a period of time necessary to achieve a pre-selected count value.

10. The method of claim 7, wherein the signals are indicative of an estimated travel speed associated with flywheel rotation.

11. The method of claim 10, wherein obtaining a current calibration data for the trainer includes calculating the total time elapsed from a first travel speed to a second travel speed.

12. The method of claim 7, wherein the standard calibration data is generic to a class of trainers.

13. The method of claim 7, wherein the standard calibration data is specific to a particular user's trainer.

14. The method of claim 7, wherein applying a load generated by the load generator includes applying a constant current to the load generator for producing a magnetic field through which the outer portion of the flywheel is rotated.

15. The method of claim 7, wherein applying a load generated by the load generator includes applying a constant voltage to the load generator for producing a magnetic field through which the outer portion of the flywheel is rotated.

16. The method of claim 7, wherein applying a load generated by the load generator includes:

applying a variable current to the load generator for producing a magnetic field through which the outer portion of the flywheel is rotated.

* * * * *